United States Patent [19]

Buckner

[11] 3,999,533

[45] Dec. 28, 1976

[54] AIR RIFLE HAVING A NOVEL ADAPTER HANDLE FOR PUMPING

[76] Inventor: Harry F. Buckner, c/o 3665 Pardee, Dearborn, Mich. 48124

[22] Filed: Dec. 29, 1975

[21] Appl. No.: 644,867

[52] U.S. Cl. ..... 124/69; 124/67; 124/80

[51] Int. Cl.[2] ..... F41B 11/00; F41F 1/04

[58] Field of Search ..... 124/25, 26, 27, 28, 124/66, 67, 68, 69, 70, 76, 80; D22/6, 7

[56] References Cited

UNITED STATES PATENTS

| | | | |
|---|---|---|---|
| 173,540 | 2/1876 | Hebler | 124/76 |
| 1,107,586 | 8/1914 | Burnam | 124/27 |
| 1,214,398 | 1/1917 | Welch | 124/69 |
| 1,405,012 | 1/1922 | Schneider | 124/67 |
| 1,692,555 | 11/1928 | Lewis | 124/67 |
| 2,150,288 | 3/1939 | Moller | 124/67 |
| 2,604,088 | 7/1952 | Wells | 124/67 |
| 2,638,884 | 5/1953 | Wells | 124/67 |
| 3,824,981 | 7/1974 | Crane et al. | 124/40 X |

FOREIGN PATENTS OR APPLICATIONS

| | | | |
|---|---|---|---|
| 44,542 | 11/1908 | Switzerland | 124/25 |

*Primary Examiner*—Richard T. Stouffer

[57] ABSTRACT

A novel adapter handle is attached to the existing pumping handle of an air rifle to increase the pumping leverage. The adapter handle has a forward portion which is disposed beneath and is attached to the existing pumping handle and a rear portion disposed to one side of the existing trigger guard. The rear portion includes cut-outs around the trigger guard providing finger clearance to the trigger and safety. The rear portion terminates in a hand grip which is grasped by the user to pump the rifle.

7 Claims, 4 Drawing Figures

AIR RIFLE HAVING A NOVEL ADAPTER HANDLE FOR PUMPING

BACKGROUND AND SUMMARY OF THE INVENTION

This invention relates to air rifles and in particular to the pumping mechanism for an air rifle.

In an air rifle a charge of compressed air is used to propel a projectile from the rifle. In one type of an air rifle the charge of air is developed by means of a manually operable pumping mechanism wherein the pumping handle is pivoted for reciprocation by the user in developing the charge. Usually the pumping handle must be reciprocated a number of times against an increasing head of pressure and because of the existing leverage, it is often difficult, if not impossible, for younger boys to pump up the rifle. Often it is dad who must do the pumping and this can detract from the son's self satisfaction as well as possibly being an inconvenience to dad.

The present invention is concerned with a novel adapter handle for an air rifle which is attached to the existing pumping handle. The invention makes it possible for a younger boy to pump up an air rifle without assistance. Importantly however, the invention does not impair the user's convenience in firing the air rifle; indeed, for a young boy, the invention may even facilitate convenience in firing. Moreover, the adapter handle of the invention may be readily economically fabricated and installed on an air rifle.

The foregoing features, advantages and benefits of the invention will be seen in the ensuing description and claims which are to be considered in conjunction with the accompanying drawing illustrating a preferred embodiment of the invention according to the best mode presently contemplated in carrying out the invention.

DESCRIPTION OF THE PREFERRED EMBODIMENT

Figure 1:
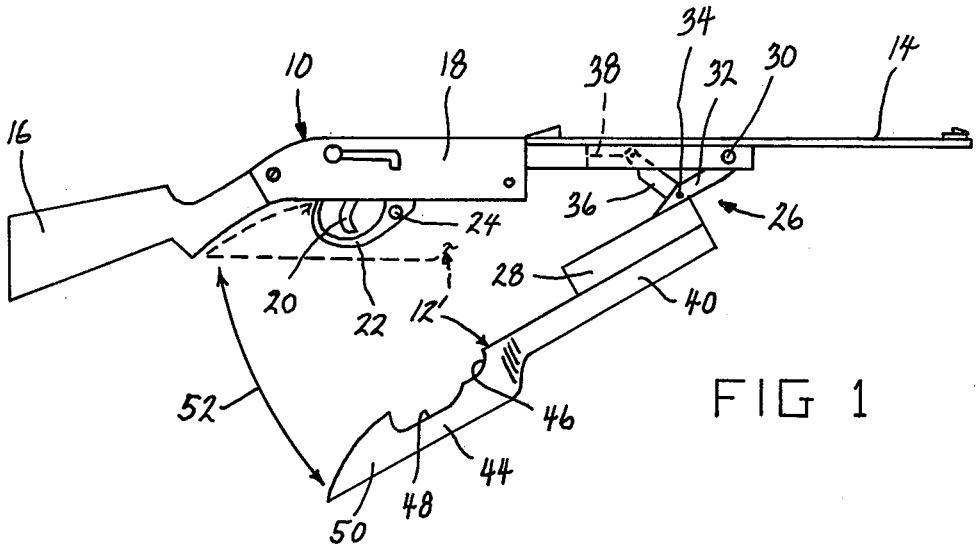
FIG. 1 is a side elevational view of an air rifle with the novel adapter handle according to the present invention.
Figure 2:
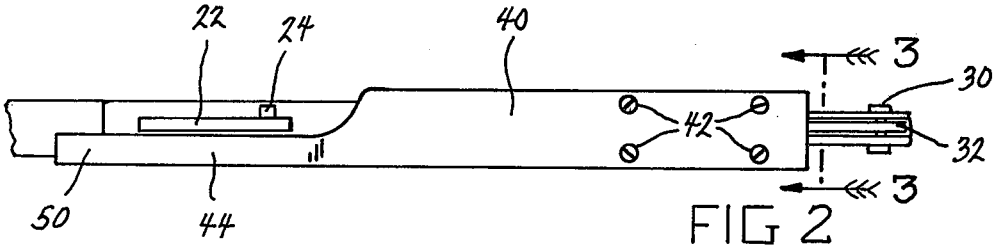
FIG. 2 is a fragmentary bottom view of the adapter handle on a slightly enlarged scale.
Figure 3:
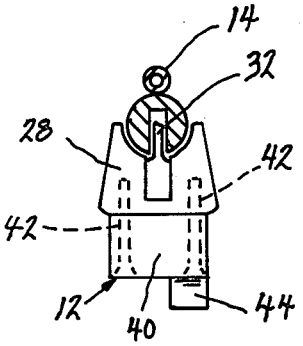
FIG. 3 is a sectional view taken in the direction of arrows 3—3 in FIG. 2.

FIGS. 1, 2, and 3 illustrate an air rifle 10 on which is mounted an adapter handle 12 embodying principles of the present invention. Air rifle 10 is entirely conventional and includes a barrel 14, a stock 16, an action 18, a trigger 20, a trigger guard 22, a safety 24 and a pumping mechanism generally identified by the numeral 26. The pumping mechanism for the most part is self-contained within the rifle but is actuated by a manually graspable wooden pumping handle 28 pivoted about a pivot 30 through a connecting lever 32. Pivoted on lever 32 about a pivot 34 is a link 36 whose other end is pivotally attached to the piston rod 38 of an air compression cylinder (not shown) within the rifle. FIG. 1 illustrates handle 28 displaced counter-clockwise from its normal firing position. From the illustrated position, handle 28 may be pivoted clockwise about pivot 30, as viewed in FIG. 1, by the user to actuate the air compression cylinder so that an amount of air is compressed in a compression chamber in the rifle. The pumping handle is normally reciprocated a number of times to develop a suitable charge of compressed air for firing a projectile from the air rifle. Once the charge has been developed, the handle is left in a stored position beneath and parallel to barrel 14. The rifle may then be aimed and fired by pulling trigger 20. An example of an air rifle of this type is a Crosman "Power Master 760".

According to the present invention, adapter handle 12 is attached to the existing pumping handle 28 in order to increase the leverage of the pumping mechanism. Adapter handle 12 comprises a forward portion 40 disposed directly beneath and against handle 28. Suitable clearance holes are provided in adapter handle 12 so that threaded screws 42 may be passed upwardly therethrough and threaded into suitable holes added to handle 28. Thus, adapter handle 12 is sturdily affixed to the existing pumping handle 28.

Adapter handle 12 further comprises a rear portion 44 which is disposed to one side of trigger guard 22 and which is downwardly offset relative to forward portion 40. As best seen in FIG. 2, the rear portion 44 has an appreciably reduced width from forward portion 40; however, it is not laterally offset relative to the forward portion. Rear portion 44 has a pair of cut-outs 46, 48 formed in its upper edge contoured to approximately register with trigger guard 22 and to provide finger clearance to both trigger 20 and safety 24. The rear portion of the adapter handle terminates in a hand grip 50 rearwardly of cut-out 48 and this hand grip is intended to be manually grasped by the user for pumping. As should be apparent from the drawing, handle 12 is reciprocated relative to the barrel along the path indicated by the arrow 52 to operate the air compression mechanism. When a user pumps the rifle via hand grip 50, the pumping leverage is significantly increased. Thus, a young boy can now pump the air rifle by himself.

It is desirable to construct the adapter handle from a piece of hardwood, such as oak or maple, so that it is both strong and decorative.

Several important features should be noted. The forward portion 40 of the adapter handle is made approximately the same width and height as the existing handle 28 so that it can form a hand grip for the user when the rifle is aimed and fired. Moreover, the hand grip provided by forward portion 40 may be more convenient for a smaller boy than the existing pumping handle 28. In addition, the adapter handle stores conveniently on the underside of the rifle so as not to interfere with aiming and firing. Also, finger access to the trigger and safety is unimpaired. Because hand grip 50 is not laterally offset relative to the center-line of the pumping mechanism, there is no tendency for the rifle and adapter handle to twist with respect to each other when the gun is being pumped. Also it should be pointed out that the illustrated adapter handle has its rear portion disposed to the left-hand side of trigger guard 22 which is particularly convenient for a left-handed user since the last three fingers of his left hand can wrap beneath and around hand grip 50. A right-hand design can be made for a right-handed person.

Figure 4:
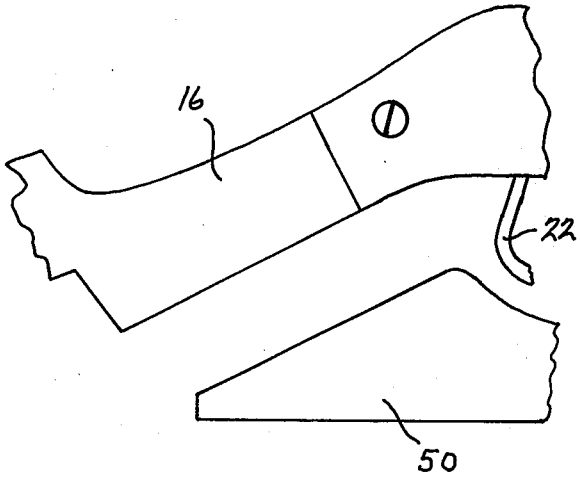
FIG. 4 is a fragmentary view illustrating a modification.

FIG. 4 illustrates a modification wherein hand grip 50 is shaped to provide finger clearance around the stock hand grip for the last three fingers of the shooting hand, which may be desirable in some cases depending on the size of the user's hand and fingers.

Thus, the adapter handle of the invention enhances the utility and ease of operation of an air rifle and at a very modest cost.

What is claimed is:

1. In combination with an air rifle having a forwardly extending barrel and an air compression mechanism which is manually operable by a user of the rifle through an existing handle which is disposed for shooting in a position immediately beneath and parallel to the barrel and which is pivotally mounted by actuating linkage for said mechanism about an axis transverse to the barrel for pivotal displacement downwardly and forwardly from said position relative to the barrel and which is pivotally reciprocated from and to said position to operate said air compression mechanism via said linkage and thereby develop a charge of compressed air used to fire a projectile from the rifle, said air rifle including a trigger disposed rearwardly of said handle, a trigger guard for said trigger, and a safety carried by said trigger guard on one laterally directed side thereof, an adapter handle for said air compression mechanism comprising a forward portion disposed immediately beneath and against said existing handle, means attaching said forward portion of said adapter handle to said existing handle, said forward portion of said adapter handle being shaped to form a first hand grip which may be grasped by a hand of the user to support the rifle during shooting, said adapter handle comprising a rear portion extending rearwardly from said forward portion thereof, said rear portion of said adapter handle just rearwardly of said forward portion being next adjacent to said trigger and said trigger guard, said just rearwardly rear portion, when said existing handle is in said first-mentioned position thereof, being disposed only to a second side of said trigger and said trigger guard opposite to said one side of said trigger guard carrying said safety and being shaped to provide finger clearance around said trigger guard and said safety on said one side so that the user can actuate said trigger and said safety, said rear portion extending rearwardly beyond said trigger guard to terminate in a second hand grip which may be grasped by the user to operate said air compression mechanism with greater leverage than can be obtained via said existing handle.

2. The combination of claim 1 wherein said rear portion is downwardly offset relative to said forward portion.

3. The combination of claim 1 wherein said rear portion has a maximum lateral dimension less than the maximum lateral dimension of said forward portion.

4. The combination of claim 1 wherein said second hand grip is disposed for firing such that the last three fingers of a user's shooting hand may wrap therebeneath and therearound.

5. The combination of claim 1 wherein said rifle has a rearwardly extending stock and wherein said second hand grip is disposed for firing such that finger clearance is provided between it and the stock of the air rifle for the last three fingers of a user's shooting hand.

6. The combination of claim 1 wherein said adapter handle is made from a solid hardwood.

7. The combination of claim 1 wherein said attaching means comprises a plurality of fasteners passing through said forward portion into said existing handle.

* * * * *